US011629718B2

(12) United States Patent
Spargo

(10) Patent No.: US 11,629,718 B2
(45) Date of Patent: Apr. 18, 2023

(54) PUMPING UNITS, PUMP ASSEMBLIES AND PUMPING METHODS

(71) Applicant: Rick D. Spargo, Hoxie, AR (US)

(72) Inventor: Rick D. Spargo, Hoxie, AR (US)

( * ) Notice: Subject to any disclaimer, the term of this patent is extended or adjusted under 35 U.S.C. 154(b) by 73 days.

(21) Appl. No.: 16/875,190

(22) Filed: May 15, 2020

(65) Prior Publication Data

US 2021/0355945 A1 Nov. 18, 2021

(51) Int. Cl.

| | |
|---|---|
| ***F04D 3/02*** | (2006.01) |
| ***F04D 29/54*** | (2006.01) |
| ***F04B 23/02*** | (2006.01) |

(52) U.S. Cl.

CPC ..... *F04D 3/02* (2013.01); *F04B 23/023* (2013.01); *F04D 29/548* (2013.01); *F05B 2240/12* (2013.01); *F05B 2240/30* (2013.01)

(58) Field of Classification Search

CPC ..... F04D 3/02; F04D 29/181; F04D 29/528; F04D 29/548; F04D 29/64; F04D 29/648; F04D 29/70; F04D 29/701; F04D 29/703; F04D 29/705; F04D 29/706; F04D 29/708; F04B 23/023; F05B 2240/12; F05B 2240/30

See application file for complete search history.

(56) References Cited

U.S. PATENT DOCUMENTS

| | | | | |
|---|---|---|---|---|
| 1,618,338 A | | 2/1927 | Hoffman | |
| 2,744,465 A | | 5/1956 | Springer | |
| 3,163,119 A | * | 12/1964 | Huppert | F04D 3/02 415/72 |

(Continued)

*Primary Examiner* — Woody A Lee, Jr.
*Assistant Examiner* — Elton K Wong
(74) *Attorney, Agent, or Firm* — R. Keith Harrison

(57) ABSTRACT

Pump assemblies may include a pumping unit. The pumping unit may include at least one impeller having an impeller housing with an impeller housing intake end, an impeller housing outlet end and an impeller housing interior extending from the impeller housing intake end to the impeller housing outlet end. An impeller assembly may be disposed in the impeller housing interior of the impeller housing. The impeller assembly may include an impeller hub. At least one impeller screw blade may extend from the impeller hub. An impeller shaft may drivingly engage the impeller hub for rotation of the impeller assembly in the impeller housing interior. The impeller shaft may be configured for driving connection to the power unit. At least one diffuser may include a diffuser housing with a diffuser housing intake end disposed in fluid communication with the impeller housing outlet end of the impeller housing of the impeller, a diffuser housing outlet end and a diffuser housing interior extending from the diffuser housing intake end to the diffuser housing outlet end. A plurality of diffuser vanes may be disposed in the diffuser housing interior of the diffuser housing. At least one pump extension may include a pump extension housing with a pump extension housing intake end disposed in fluid communication with the diffuser housing outlet end of the diffuser housing, a pump extension housing outlet end and a pump extension housing interior extending from the pump extension housing intake end to the pump extension housing outlet end. Methods of pumping a liquid from an area to be drained to a discharge area are also disclosed.

10 Claims, 16 Drawing Sheets

(56) References Cited

U.S. PATENT DOCUMENTS

| | | | | |
|---|---|---|---|---|
| 3,270,677 | A * | 9/1966 | Eller | F04D 3/005 138/40 |
| 3,957,403 | A * | 5/1976 | Sloan | F04D 29/049 415/230 |
| 4,170,436 | A | 10/1979 | Candler | |
| 4,813,849 | A | 3/1989 | Grujanac et al. | |
| 6,474,962 | B1 * | 11/2002 | Allen | F04D 3/02 417/423.15 |
| 6,988,874 | B2 | 1/2006 | Spargo | |
| 8,007,249 | B2 | 8/2011 | Spargo | |
| 8,734,092 | B1 | 5/2014 | Spargo | |
| 9,494,164 | B2 | 11/2016 | Baski | |
| 9,512,583 | B1 | 12/2016 | Spargo | |
| 2008/0317606 | A1 * | 12/2008 | Spargo | F04D 29/648 417/423.9 |
| 2011/0209346 | A1 * | 9/2011 | Kobayashi | F04D 15/0088 29/888.024 |
| 2016/0327054 | A1 * | 11/2016 | Krakers | F03B 3/126 |

* cited by examiner

PUMPING UNITS, PUMP ASSEMBLIES AND PUMPING METHODS

FIELD

Illustrative embodiments of the disclosure relate to pumping devices suitable for pumping water and/or other liquid from a flooded area or other area to be drained. More particularly, illustrative embodiments of the disclosure relate to pump assemblies and methods which are versatile and scalable, to a variety of pumping applications.

BACKGROUND

The background description provided herein is solely for the purpose of generally presenting the context of the illustrative embodiments of the disclosure. Aspects of the background description are neither expressly nor impliedly admitted as prior art against the claimed subject matter.

In many areas around the world, levees are constructed along the bank of a river or other water body which has a tendency to flood periodically. The areas outside the levees may be low-lying areas which have a tendency to flood in heavy precipitation. These flood-prone areas may be used for fanning or other purposes which may be hampered by a heavy water load. Therefore, it may be necessary to periodically expeditiously transport a large volume of water from a flood-prone low-lying area and discharge the water into a lake, river or other natural or artificial water body, drainage outlet or reservoir, particularly under flood conditions.

Accordingly, pumping units, pump assemblies and pumping methods which are versatile and scalable in size may be useful for some applications.

SUMMARY

Illustrative embodiments of the disclosure are generally directed to pump assemblies suitable for driving connection to a power unit to pump liquid from an area to be drained to a discharge area. An illustrative embodiment of the pump assemblies may include a pumping unit. The pumping unit may include at least one impeller having an impeller housing with an impeller housing intake end, an impeller housing outlet end and an impeller housing interior extending from the impeller housing intake end to the impeller housing outlet end. An impeller assembly may be disposed in the impeller housing interior of the impeller housing. The impeller assembly may include an impeller hub. At least one impeller screw blade may extend from the impeller hub. An impeller shaft may drivingly engage the impeller hub for rotation of the impeller assembly in the impeller housing interior. The impeller shaft may be configured for driving connection to the power unit. At least one diffuser may include a diffuser housing with a diffuser housing intake end disposed in fluid communication with the impeller housing outlet end of the impeller housing of the impeller, a diffuser housing outlet end and a diffuser housing interior extending from the diffuser housing intake end to the diffuser housing outlet end. A plurality of diffuser vanes may be disposed in the diffuser housing interior of the diffuser housing. At least one pump extension may include a pump extension housing with a pump extension housing intake end disposed in fluid communication with the diffuser housing outlet end of the diffuser housing, a pump extension housing outlet end and a pump extension housing interior extending from the pump extension housing intake end to the pump extension housing outlet end.

In some embodiments, the pump assembly may be configured as a re-lift pump suitable for driving connection to a power unit to pump liquid to a discharge area. An illustrative embodiment of the pump assembly may include a substantially vertically oriented pumping unit having at least one impeller. The impeller may include an impeller housing with an impeller housing intake end, an impeller housing outlet end and impeller housing interior extending from the impeller housing intake end to the impeller housing outlet end. An impeller assembly may be disposed in the impeller housing interior of the impeller housing. The impeller assembly may include, an impeller hub. At least one impeller screw blade may extend from the impeller hub. An impeller shaft may drivingly engage the impeller hub for rotation of the impeller assembly in the impeller housing interior. The impeller shaft may be configured for driving connection to the power unit. At least one diffuser may include a diffuser housing with a diffuser housing intake end disposed in fluid communication with the impeller housing outlet end of the impeller housing, a diffuser housing outlet end and a diffuser housing interior extending from the diffuser housing intake end to the diffuser housing outlet end. A plurality of diffuser vanes may be disposed in the diffuser housing interior of the diffuser housing. At least one pump extension may have a pump extension housing with a pump extension housing intake end disposed in fluid communication with the diffuser housing outlet end of the diffuser housing, a pump extension housing outlet end and a pump extension housing interior extending from the pump extension housing intake end to the, pump extension housing outlet end. A re-lift cap may include a re-lift cap housing disposed in fluid communication with the pump extension housing outlet end of the pump extension housing of the at least one pump extension. A substantially horizontal drain conduit arm disposed in fluid communication with the re-lift cap housing.

Illustrative embodiments of the disclosure are further generally directed to methods of pumping a liquid from an area to be drained to a discharge area. An illustrative embodiment of the methods may include obtaining a pump assembly including a pumping unit having at least one impeller, at least one, diffuser disposed in fluid communication with the at least, one impeller and at least one pump extension disposed in fluid communication with the at least one diffuser; placing the at least one impeller of the pumping unit in fluid communication with the area to be drained; placing a drain conduit in fluid communication with the at least one pump extension of the pumping unit of the pump assembly; placing the drain conduit in fluid communication with the discharge area; drivingly coupling an impeller shaft with the at least one impeller; drivingly coupling the impeller shaft with a power unit; and pumping the liquid from the area to be drained and into the discharge area through the at least one impeller, the at least one diffuser and the at least one pump extension, respectively, of the pumping unit and through the drain conduit by operation of the power unit.

BRIEF DESCRIPTION OF THE DRAWINGS

Illustrative embodiments of the disclosure will now be described, by way of example, with reference to the accompanying drawings, in which.

DETAILED DESCRIPTION

Figure 1A:
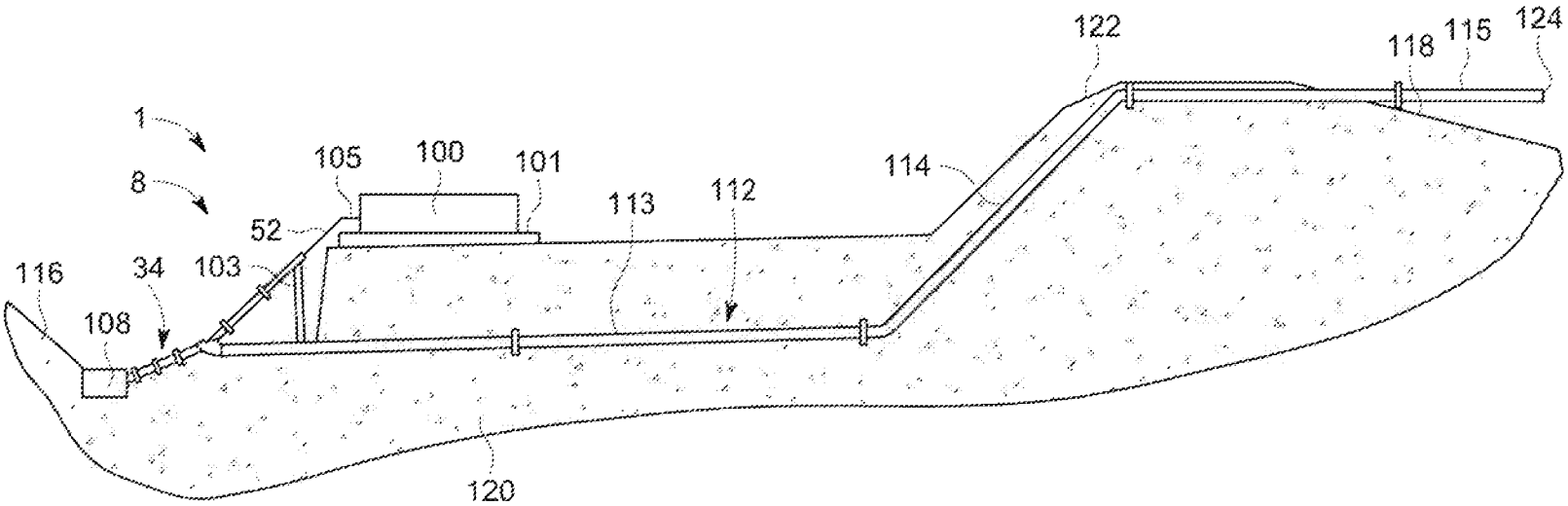
FIG. 1A is a side view of an illustrative embodiment of the pumping units of the disclosure, assembled in a pump assembly configured as a levee pump, more particularly illustrating, typical, application of the pumping units and pump assemblies in pumping floodwater from an area to be drained, through a levee to a discharge area.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Referring initially to FIGS. 1A, 1B and 37-40 of the drawings, an illustrative embodiment of the pump assemblies is generally indicated by reference numeral 1. In typical application, which will be hereinafter described, the pump assembly 1 may be configured as a levee pump 8 to pump water and/or other liquid 142 (FIG. 1B) from an area to be drained 116 to a discharge area 118. In some applications, the area to be drained 116 may include a floodplain, ditch and/or other area or areas prone to flooding, for example and without limitation. The discharge area 118 may include a river, lake and/or other natural or manmade body of water or other reservoir. At least one drain conduit 112 may be coupled to the pump assembly 1. In some applications, the drain conduit 112 may extend from the pump assembly 1 through a levee 122 between the area to be drained 116 and the discharge area 118 prior to discharging at the discharge area 118. The pump assembly 1 may be drivingly coupled to a power unit 100 for operation, typically as will he hereinafter described. As illustrated in FIGS. 37-40, in other applications, the pump assembly 1*a* may be configured as a re-lift pump 126. In still other applications, other configurations of pump assemblies are possible.

The size of the pump assembly 1 configured as the levee pump 8 (FIGS. 1A and 1B) may be scalable to various applications depending on such parameters as the distance between the area to be drained 116 and the discharge area 118, the depth of the area to be drained 116 and the height of the levee 122. The size of the pump assembly 1*a* configured as the re-lift pump 126 may depend on such parameters as the required pumping height of the water and/or other liquid 142. Additionally, the pump assembly 1 and the pump assembly 1*a* may be fabricated with various, pumping capacities depending on the desired application. The pump assemblies 1, 1*a* are capable of efficient and high-capacity operation in pumping large volumes of the water and/or other liquid 142 from the area to be drained 116 to the discharge area 118.

Referring next to FIGS. 2-36 of the drawings, the pump assembly 1 configured as the levee pump 8 may include a pumping unit 34. The pumping unit 34 may include at least one impeller 36. An intake cap 54 may be provided on the impeller 36. At least one diffuser 20 may extend from the impeller 36. At least one pump extension 2 may extend from the diffuser 20. The pump, extension or extensions 2 may facilitate a desired length of the pumping, unit 34 to accord with a particular application of the pump assembly 1, typically as will be hereinafter described. Accordingly, in typical application of the pump assembly 1, which will be hereinafter described, the pumping unit 34 may be operable to pump the water and/or other liquid 142 (FIG. 1B) from the area to be drained 116 through the intake cap 54, the impeller 36, the diffuser 20 and the pump extension or extensions 2, respectively, of the pumping unit 34. The water and/or other liquid 142 may then flow from the pumping unit 34 through the other components of the pump assembly 1, which will be hereinafter described, and typically through the drain conduit 112 into the discharge area 118, respectively. In some embodiments, at least one deployment flange 12 may be provided on the exterior surface of the pump extension housing 3 of the pumping unit 34 and the, other components of the pump assembly 1 for attachment to a crane or other support vehicle or structure (not illustrated) in deployment of the pump assembly 1 in place.

As illustrated in FIGS. 7-13, the impeller 36 of the pumping unit 34 may have an impeller housing 37 with an impeller intake end 39, an impeller outlet end 40 and an impeller interior 44 (FIG. 8) extending from the impeller intake end 39 to the impeller outlet end 40. An impeller assembly 48 (FIGS. 11A-13) may be provided in the impeller interior 44 of the impeller housing 37. As illustrated in FIGS. 11A-13, the impeller assembly 48 may include an impeller hub 49. At least one impeller screw blade 50 may extend outwardly from the impeller hub 49. In typical, application, two impeller screw blades 50 may extend from the impeller hub 49, with each impeller screw blade 50 typically traversing 360 degrees of the circumference of the, impeller huh 49 progressing along the length of the impeller hub 49. The impeller screw blades 50 may have an impeller blade intake end 51 disposed proximate the impeller housing intake end 39 and an impeller blade outlet end 51 disposed proximate the impeller housing outlet end 40 of the impeller housing 37. As illustrated in FIG. 11A, in some embodiments, the impeller hub 49 may have a concentric outward taper from the impeller blade intake end 51 to the impeller blade outlet end 53.

Figure 1B:
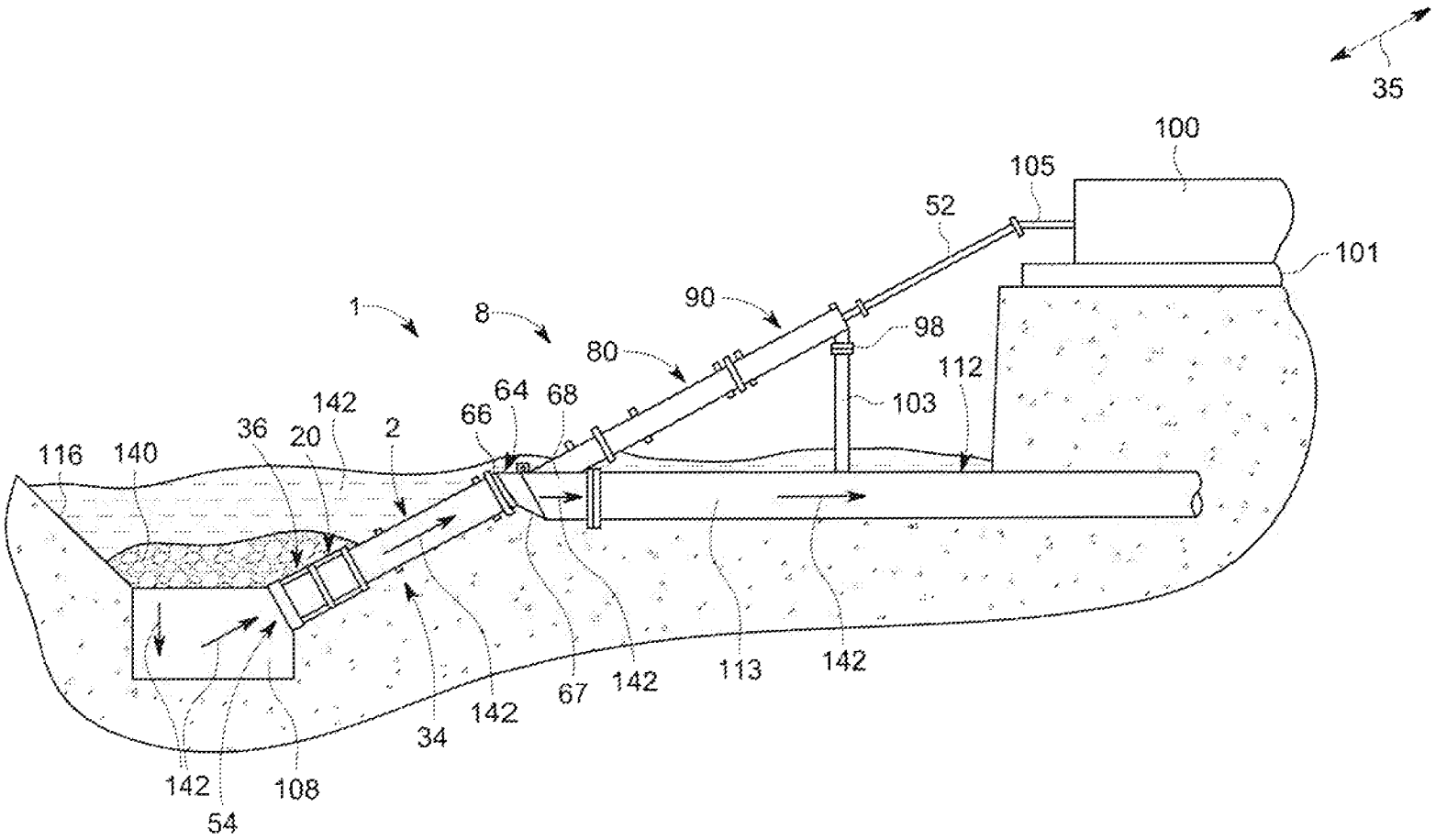
FIG. 1B is an enlarged side view of the illustrative pumping unit and pump assembly illustrated in FIG. 1A, disposed in fluid communication with water contained in the area to be drained.
Figure 11A:
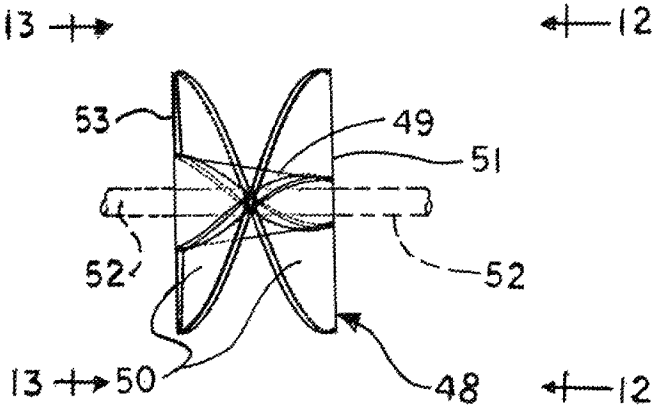
FIG. 11A is a side view of a typical impeller assembly of the impeller.
Figure 11B:
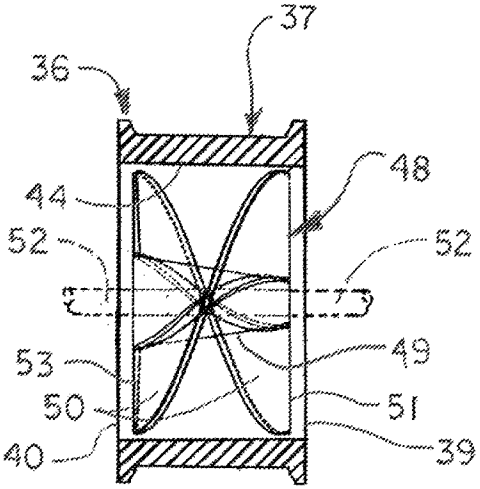
FIG. 11B is a sectional view of the impeller housing of the impeller with the impeller assembly disposed in the impeller housing.
Figure 15:
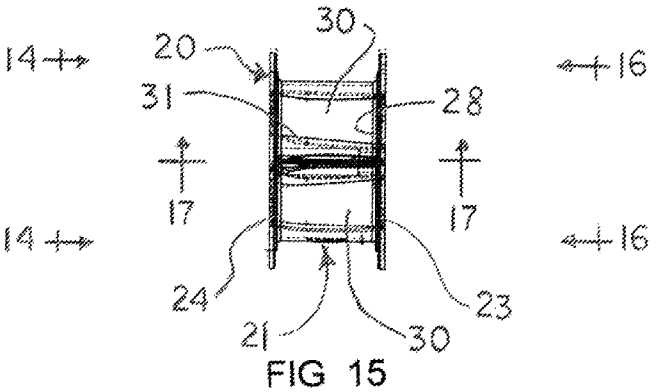
FIG. 15 is a side view of the diffuser.
Figure 17:
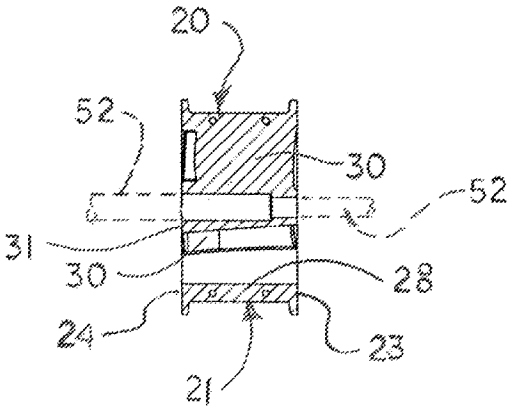
FIG. 17 is a sectional view of the diffuser, taken along section lines 17-17 in FIG. 15.
Figure 14:
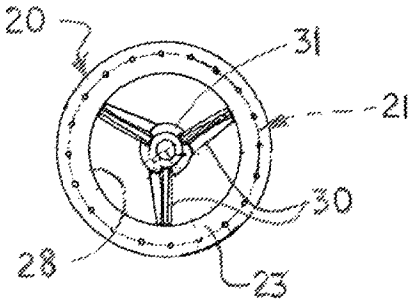
FIG. 14 is an intake end view of a typical diffuser which is suitable for implementation of the pumping unit, taken along viewing lines 14-14 in FIG. 15.
Figure 16:
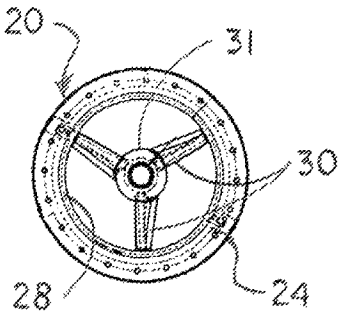
FIG. 16 is an outlet end view of the diffuser, taken along viewing lines 16-16 in FIG. 15.

As illustrated in FIGS. 11A and 11B, an impeller shaft 52 may drivingly engage the impeller hub 49 of the impeller assembly 48 for rotation of the impeller assembly 48 in the impeller housing interior 44 of the impeller housing 37, typically responsive to operation of the power unit 100 (FIGS. 1A and 1B). The impeller shaft 52 may be configured for driving connection to the power unit 100 typically as will be hereinafter described.

Figure 5:
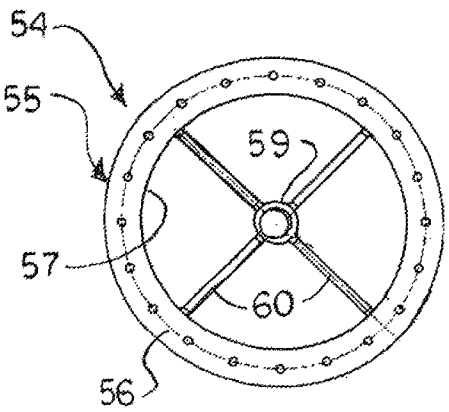
FIG. 5 is an intake end view of the intake cap, taken along viewing lines 5-5 in FIG. 6.
Figure 4:
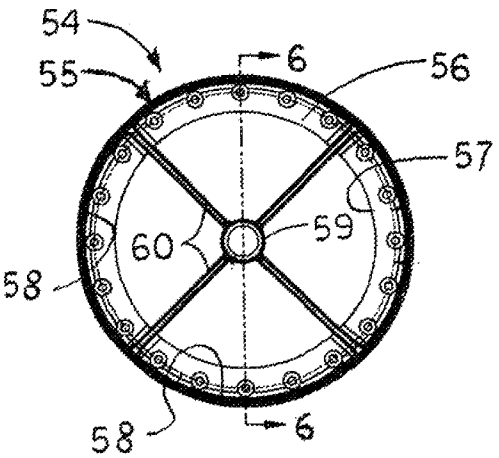
FIG. 4 is an outlet end view of a typical intake cap of the pumping unit, taken along viewing lines 4-4 in FIG. 6.
Figure 6:
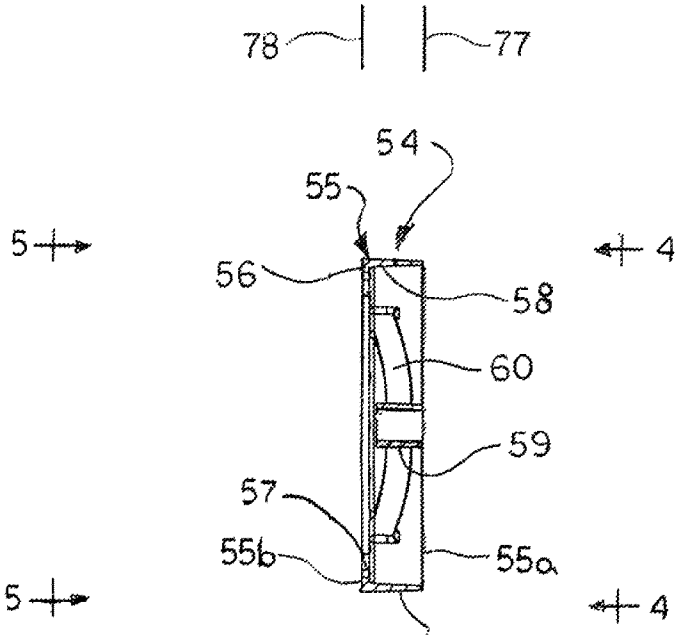
FIG. 6 is a sectional view of the intake cap, taken along section lines 6-6 in FIG. 4.
Figure 8:
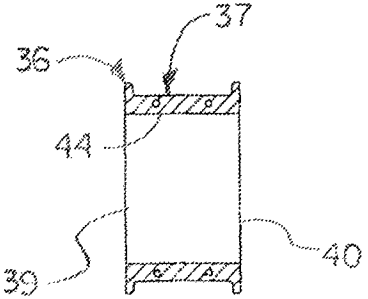
FIG. 8 is a sectional view of the impeller housing, taken along section lines 8-8 in FIG. 7.
Figure 10:
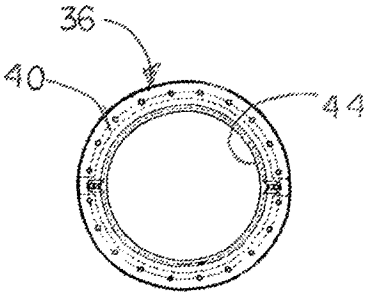
FIG. 10 is an outlet end view of the impeller housing, taken along section lines 10-10 in FIG. 7.
Figure 7:
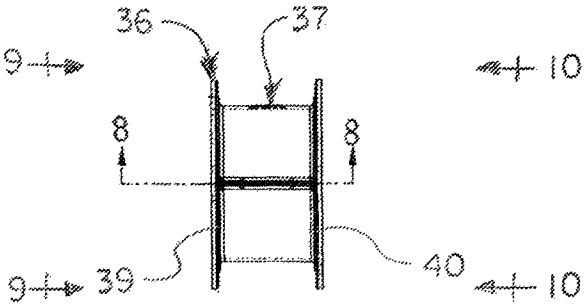
FIG. 7 is a side view of a typical impeller housing of an impeller which is suitable for implementation of the pumping unit.
Figure 9:
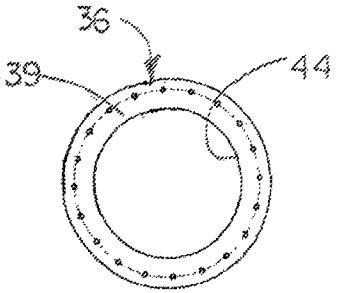
FIG. 9 is an intake end view of the impeller housing, taken along viewing lines 9-9 in FIG. 7.
Figure 12:
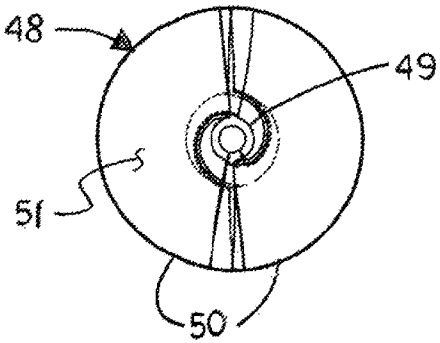
FIG. 12 is an intake end view of the impeller assembly, taken along viewing lines 12-12 in FIG. 11A.
Figure 13:
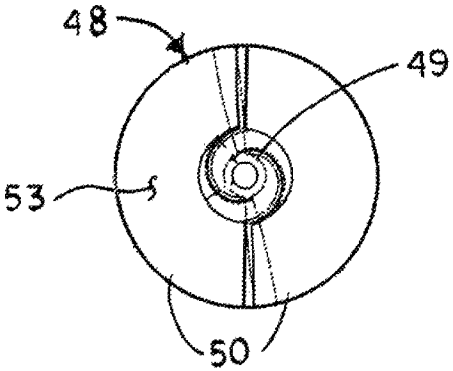
FIG. 13 is an outlet end view of the impeller assembly, taken along viewing lines 13-13 in FIG. 11A.

As illustrated in FIGS. 4-6, the intake cap 54 of the pumping unit 34 may include an intake cap housing 55 having a cylindrical housing sidewall 61. The housing sidewall 61 may have a cap sidewall intake end 55*a* and a cap sidewall outlet end 55*b*. An intake cap interior 58 formed by the housing sidewall 61 may extend from the cap sidewall intake end 55*a* to the cap sidewall outlet end 55*b*. As illustrated in the cross-sectional view of FIG. 6, the housing sidewall 61 of the intake cap housing 55 may be continuous and unbroken or unsegmented from the cap sidewall intake end 55*a* to the cap sidewall outlet end 55*b*. As further illustrated in FIG. 6, the cap sidewall intake end 55*a* may be disposed within an intake end plane 77, and the cap sidewall outlet end 55*b* may be disposed within an outlet end plane 78 which is parallel to the intake end plane 77. An intake cap housing flange 56 may protrude inwardly from the cap sidewall intake end 55*a* of the intake cap housing 55. An intake cap opening 57 may extend through the intake cap housing flange 56. A central shaft hub 59 may be disposed in the intake cap interior 58. Intake cap vanes 60 may extend inwardly from the interior surface of the intake cap housing 55 into the intake cap interior 58 to mount the shaft hub 59 in the intake cap interior 58. Accordingly, the intake cap housing 55 may be attached to the impeller housing intake end 39 of the impeller housing 37 of the impeller 36 through a flanged and bolted and/or other suitable connection. The shaft hub 59 may be suitably sized and configured to receive the impeller shaft 52 as it extends through the intake cap interior 58.

As illustrated in FIGS. 14-17, the diffuser 20 of the pumping unit 34 may include a diffuser housing 21 having a diffuser intake end 23 and a diffuser outlet end 24. A diffuser interior 28 may extend from the diffuser intake end 23 to the diffuser outlet end 24. In the assembled pumping unit 34, the diffuser intake end 23 may be disposed in fluid communication with the impeller outlet end 40 of the impeller housing 37 of the impeller 36 typically through a flanged and bolted and/or other suitable connection.

As further illustrated in FIGS. 14-17, a plurality of diffuser vanes 30 may be disposed in the diffuser interior 28 of the diffuser housing 21. The diffuser vanes 30 may extend inwardly from the interior surface of the diffuser housing 21 and converge on a diffuser hub 31 to centralize the diffuser hub 31 in the diffuser interior 28. In some embodiments, three diffuser vanes 30 may extend between the diffuser hub 31 and the diffuser housing 21 in equally spaced-apart relationship to each other. In some embodiments, the diffuser vanes 30 and the diffuser hub 31 may taper concentrically outwardly from the diffuser housing intake end 23 to the diffuser housing outlet end 24 of the diffuser housing 21. In some embodiments, the diffuser 20 may have at least three diffuser vanes 30 which may be equally spaced-apart around the circumference of the diffuser housing 21.

Figure 3:
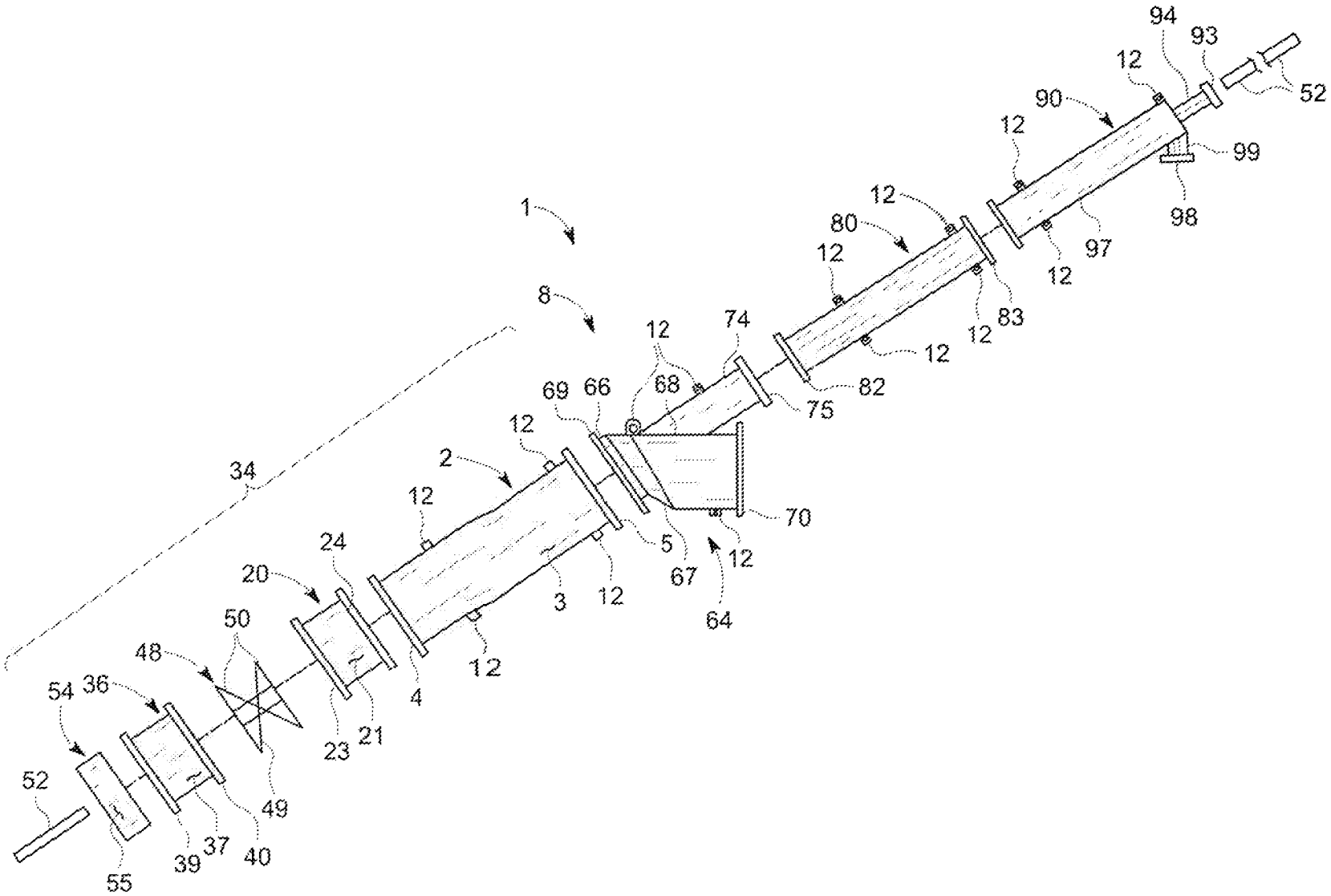
FIG. 3 is an exploded side view of the illustrative pump assembly.
Figure 19:
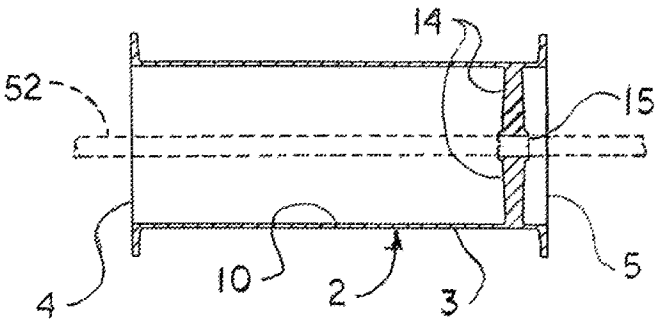
FIG. 19 is a sectional view of the pump extension, taken along, section lines 19-19 in FIG. 18.
Figure 21:
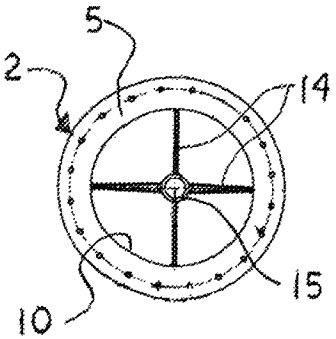
FIG. 21 is an outlet end view of the pump extension, taken along viewing lines 21-21 in FIG. 18.
Figure 18:
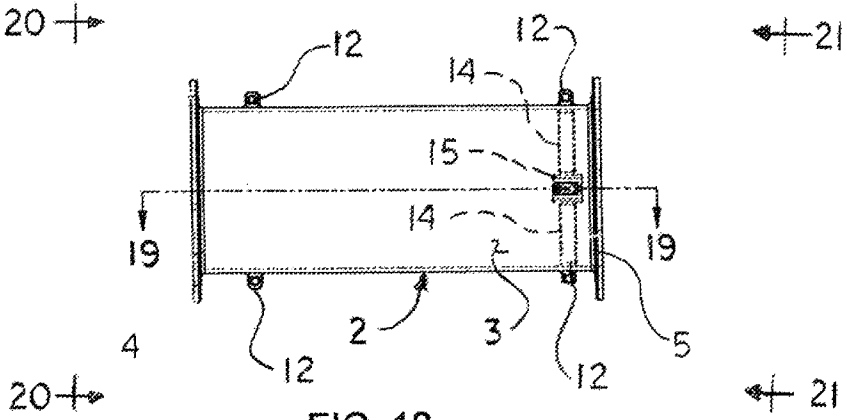
FIG. 18 is a side view of a typical pump extension which is suitable for implementation of the pumping unit.
Figure 20:
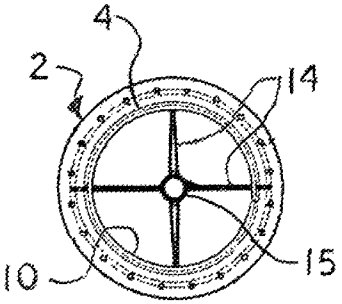
FIG. 20 is an intake end view of the pump extension, taken along viewing lines 20-20 in FIG. 18.
Figure 23:
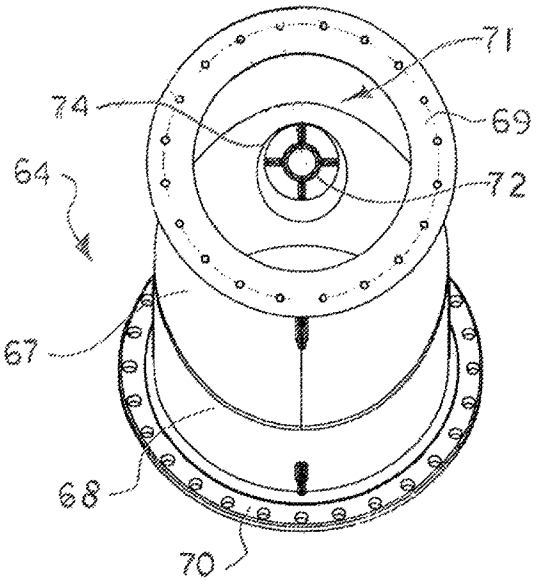
FIG. 23 is an intake end view of the main pump housing, taken along viewing lines 23-23 in FIG. 22.

As illustrated in FIGS. 18-21, the pump extension 2 of the pumping unit 34 may have a pump extension housing 3 with a pump extension intake end 4 and a pump extension outlet end 5. As illustrated in FIG. 19, a pump extension interior 10 may extend from the pump extension intake end 4 to the pump extension outlet end 5. As illustrated in FIG. 3, in the assembled pumping unit 34, the pump extension intake end 4 of the pump extension housing 3 may be disposed in fluid communication with the diffuser outlet end 24 of the diffuser housing 21 typically through a flanged and bolted and/or other suitable connection.

As further illustrated in FIG. 19, at least one shaft bearing 15 may be disposed in the pump extension housing interior 10 of the pump extension housing 3. Shaft vanes 14 may extend from the interior surface of the pump extension housing 3 to the shaft bearing 15 to centralize the shaft bearing 15 in the pump extension interior 10 as the impeller shaft 52 extends through the shaft bearing 15.

Figure 2:
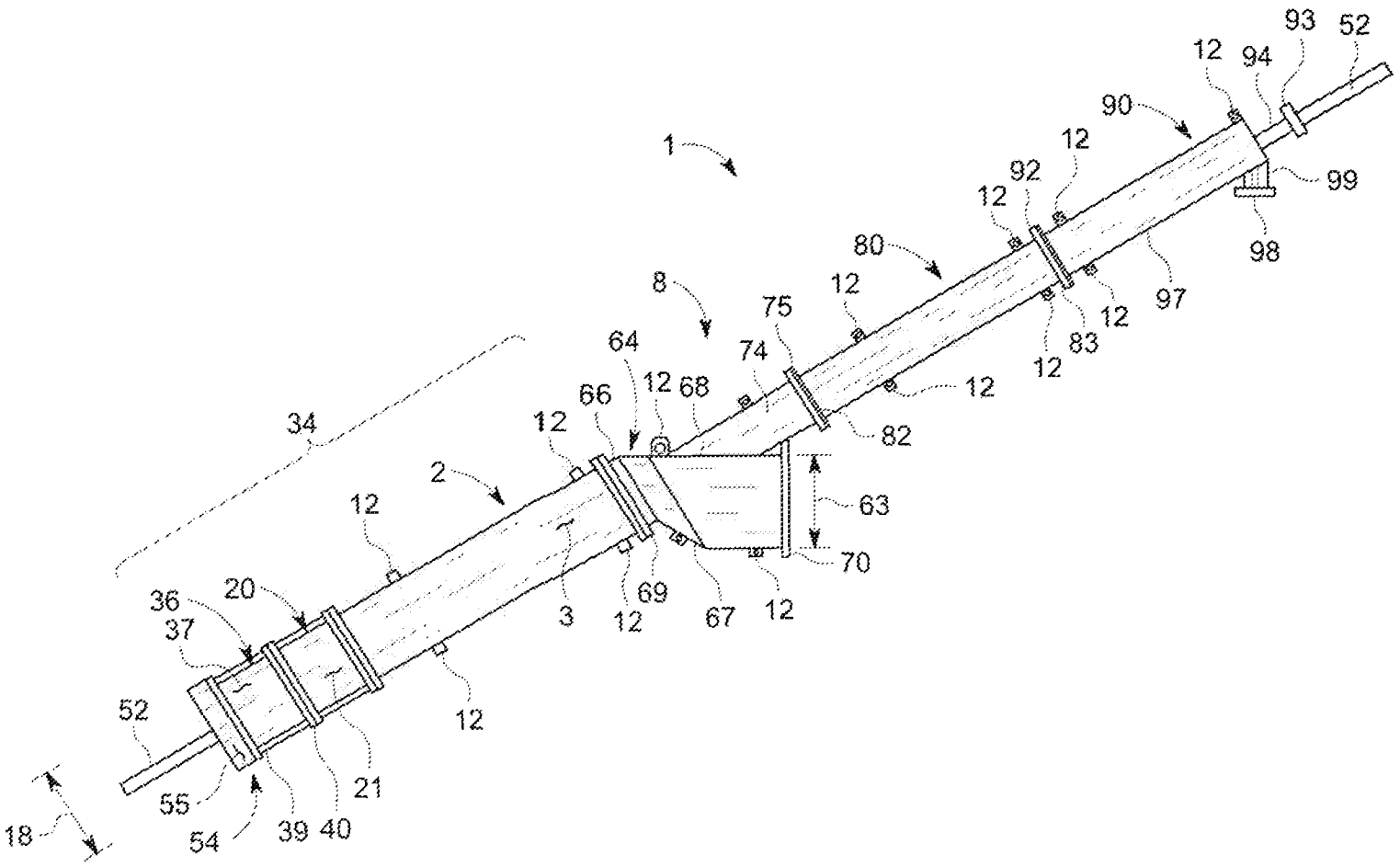
FIG. 2 is a side view of the illustrative pump assembly.
Figure 36:
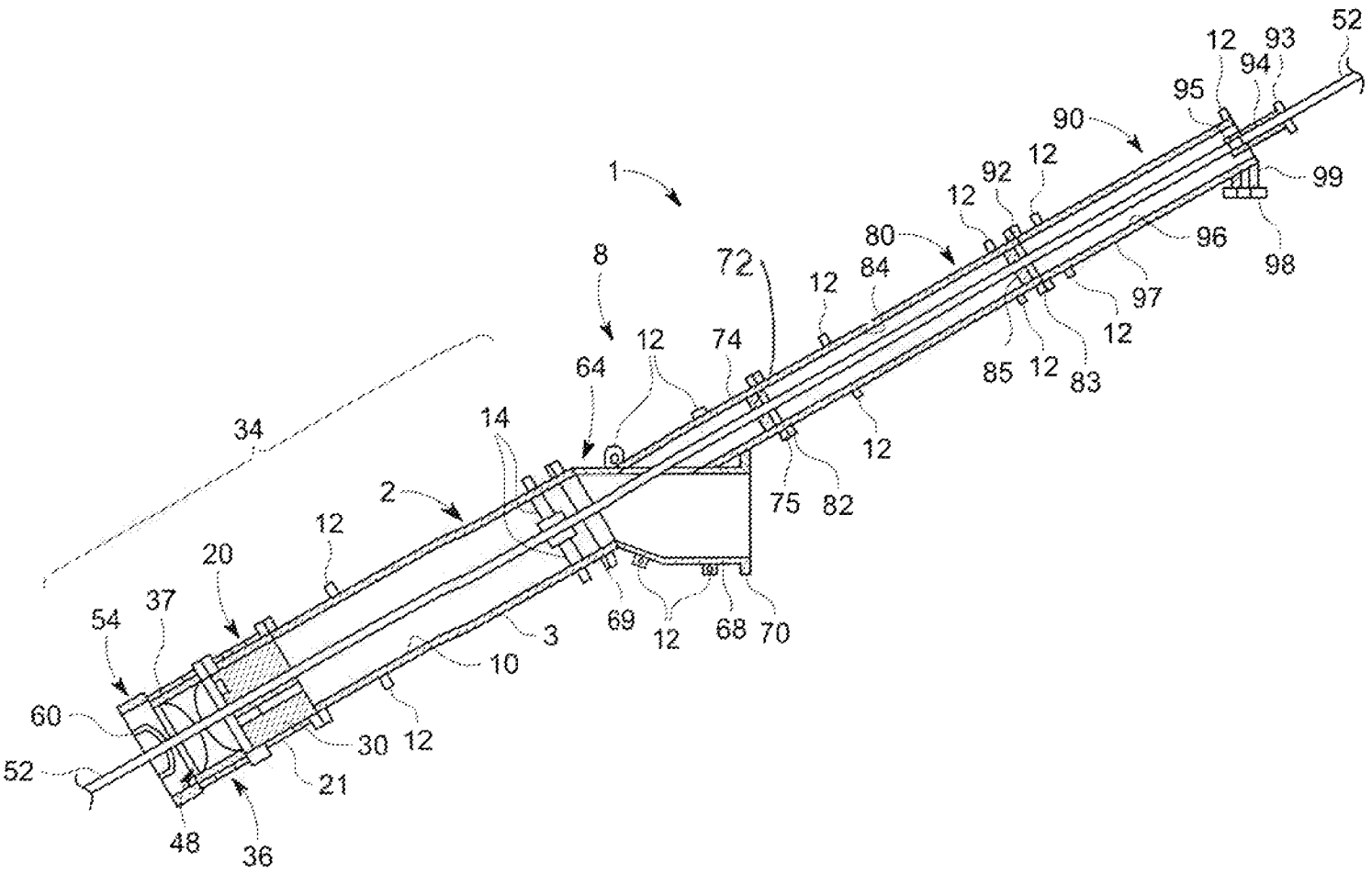
FIG. 36 is a longitudinal sectional view of the illustrative pumping unit and pump assembly.

As illustrated in FIGS. 2 and 3, in some applications of the pump assembly, a main pump housing 64 may extend from the pump extension outlet end 5 of the pump extension 2. The main pump housing 64 may be configured to facilitate coupling of drain conduit 112 (FIGS. 1A and 1B) to the pump extension 2 of the pumping unit 34. The main pump housing 64 may additionally facilitate passage of the impeller shaft 52 from the power unit 100 to the pumping unit 34. Accordingly, at least one impeller shaft housing 80 may extend from the main pump housing 64. A shaft input housing 90 may extend from the impeller shaft housing 80. As illustrated in FIG. 36, in the assembled pump assembly 1, the impeller shaft 52 may extend through the intake cap 54, the impeller 36, the diffuser 20 and the pump extension 2 of the pumping unit 34 and through the main pump housing 64, the impeller shaft housing 80 and the shaft input housing 90. respectively. The impeller shaft 52 may be drivingly coupled to a drive shaft 105 (FIGS. 1A and 1B) which may be drivingly engaged for rotation by the power unit 100.

Figure 22:
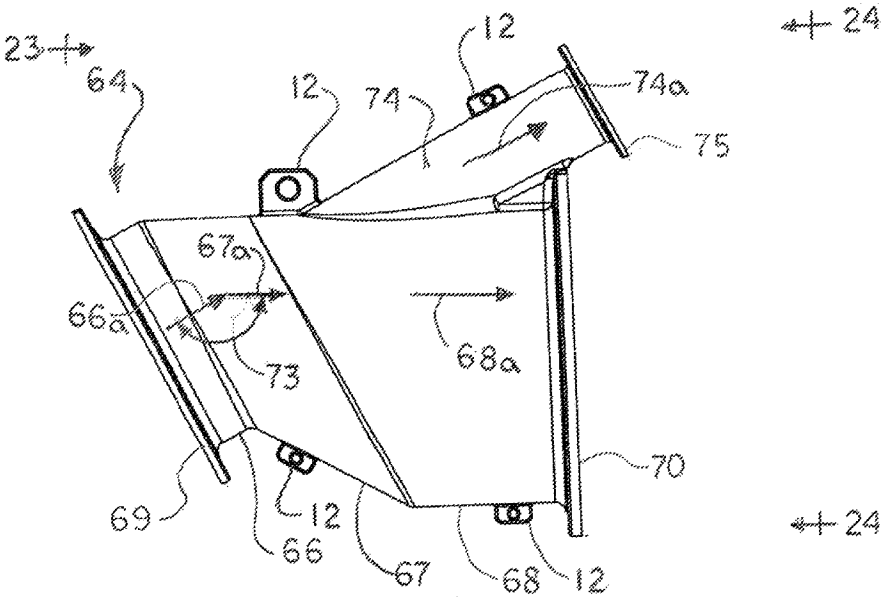
FIG. 22 is a side view of a typical main pump housing which is suitable for implementation of the pumping unit.
Figure 24:
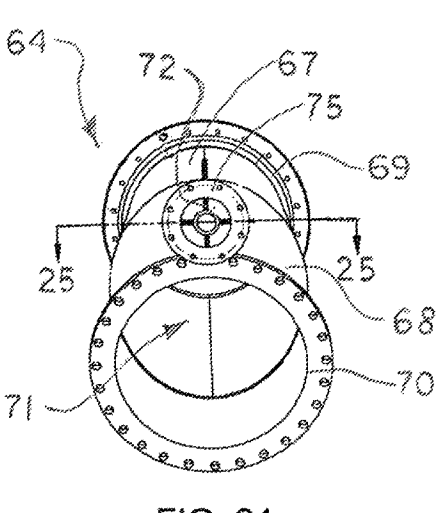
FIG. 24 is an outlet end view of the main pump housing, taken along viewing lines 24-24 in FIG. 22.

As illustrated in FIGS. 22-25, in some embodiments, the main pump housing 64 may include an intake pump housing segment 66. The intake pump housing segment 66 may have a main housing intake end 69 which is configured for coupling to the pump extension outlet end 5 (FIG. 3) of the pump extension 2 through a flanged and bolted and/or other suitable connection. A middle pump housing segment 67 may extend from the intake pump housing segment 66. As illustrated in FIG. 22, the middle pump housing segment 67 may have a middle pump housing segment flow axis 67*a* which is disposed at an obtuse angle 73 with respect to an intake pump housing segment flow axis 66*a* of the intake pump housing segment 66.

Figure 25:
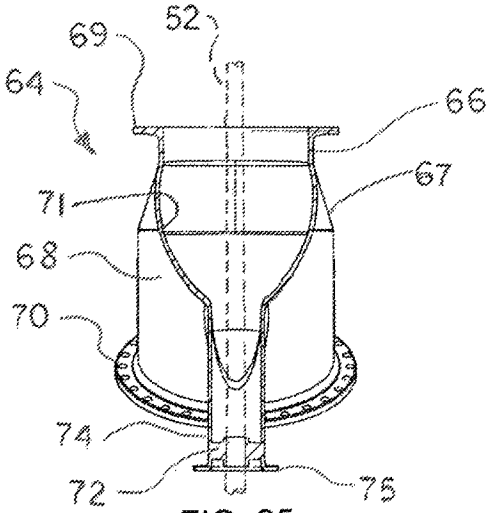
FIG. 25 is a sectional view of the main pump housing, taken along section lines 25-25 in FIG. 24.

An outlet pump housing segment 68 may extend from the middle pump housing segment 67. The outlet pump housing segment 68 may have an outlet pump housing segment flow axis 68*a* which is disposed in substantially linear alignment with the middle pump housing segment flow axis 67*a* of the middle pump housing segment 67. The outlet pump housing segment 68 may have a main housing, outlet end 70 which is configured for coupling to the drain conduit 112 (FIGS. 1A and 1B) through a flanged and bolted and/or other suitable connection. As illustrated in FIG. 25, a main pump housing interior 71 may be formed by the intake pump housing segment 66, the middle pump housing segment 67 and the outlet pump housing segment 68.

A shaft housing segment 74 may extend from the outlet pump housing segment 68 of the main pump housing 64. As illustrated in FIG. 25, the shaft housing segment 74 may be disposed in fluid communication with the main pump housing interior 71. As illustrated in FIG. 22, the shaft housing segment 74 may have a shaft housing segment axis 74*a* which is disposed substantially in linear alignment with the intake pump housing segment flow axis 66*a* of the intake pump housing segment 66. A distal housing flange 75 may terminate the distal, or extending end of the shall housing segment 74 for purposes which will be hereinafter described. As illustrated in FIG. 25, a shaft bearing 72 may be disposed in the shaft housing segment 74 to accommodate the impeller shaft 52 as it passes through the main pump housing interior 71 of the main pump housing 64. In some embodiments, at least one deployment flange 12 may be provided on the exterior surface of the main pump housing 64 for attachment to a crane or other support vehicle or structure (not illustrated) to deploy the pump assembly 1 in place.

Figure 27:
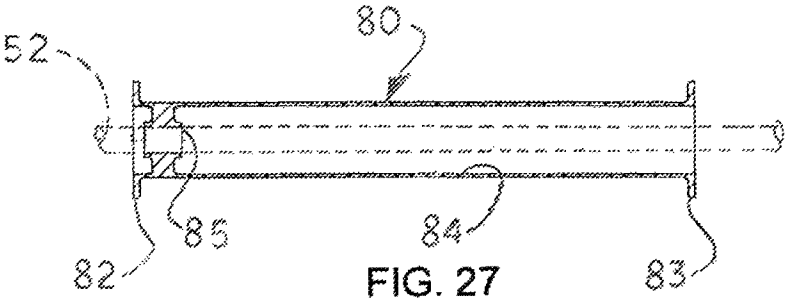
FIG. 27 is a sectional view of the impeller shaft housing, taken along section lines 27-27 in FIG. 26.
Figure 26:
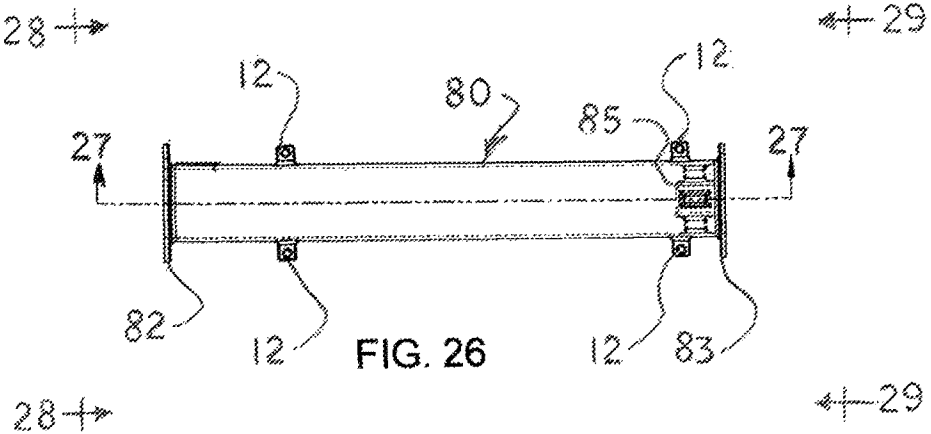
FIG. 26 is a side view of a typical impeller shaft housing suitable for implementation of the pumping unit.
Figure 29:
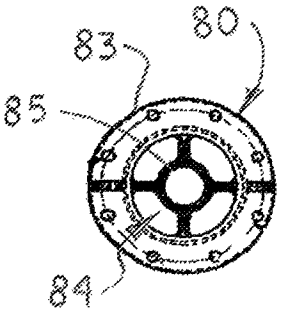
FIG. 29 is a distal end view of the impeller shaft housing, taken along viewing lines 29-29 in FIG. 26.
Figure 28:
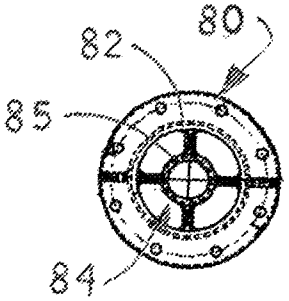
FIG. 28 is a proximal end view of the impeller shaft housing, taken along viewing lines 28-28 in FIG. 26.
Figure 32:
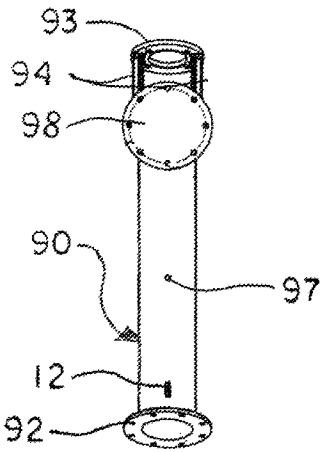
FIG. 32 is a bottom perspective view of the shaft input housing.
Figure 35:
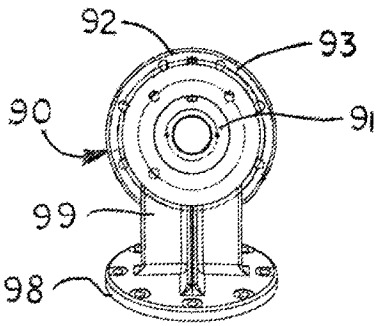
FIG. 35 is a distal end view of the shaft input housing, taken along viewing lines 35-35 in FIG. 31.
Figure 31:
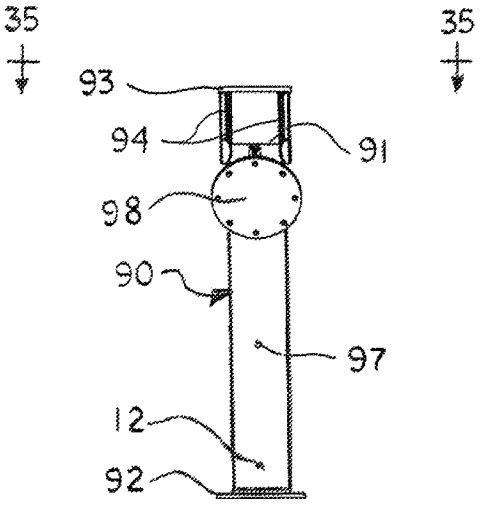
FIG. 31 is a bottom view of the shaft input housing.
Figure 34:
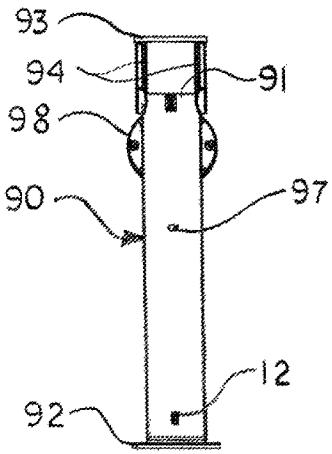
FIG. 34 is a top view of the shaft input housing.
Figure 30:
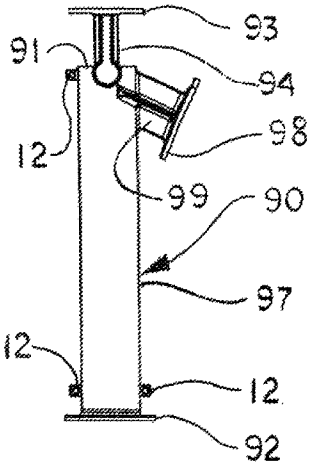
FIG. 30 is a side view of a typical shaft input housing suitable for implementation of the pumping unit.

As further illustrated in FIGS. 2 and 3, at least one impeller shaft housing 80 may extend from the shaft housing segment 74 of the main pump housing 64. As illustrated in FIGS. 26-29, the impeller shaft housing 80 may have a proximal housing flange 82 and a distal housing flange 83, in the assembled pump assembly 1, the proximal housing flange 82 may be bolted, welded and/or otherwise attached to the distal housing flange 75 on the shaft housing segment 74 of the main pump housing 64. An impeller shaft housing interior 84 may extend from the proximal housing flange 82 to the distal housing flange 83. At least one shall bearing 85 may be disposed in the housing interior 84. As illustrated in FIGS. 27 and 36, the shaft bearing 85 may accommodate the impeller shaft 52 as the impeller shaft 52 traverses the housing interior 84. In some embodiments, at least one deployment flange 12 may be provided, on the exterior surface of the impeller, shaft housing 80 for attachment to a crane or other support vehicle or structure (not illustrated) to deploy the pump assembly 1 in place.

Figure 33:
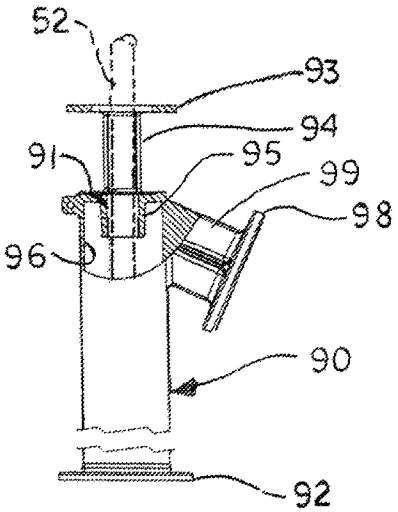
FIG. 33 is a sectioned side view of the shaft input housing.

At least one shaft input housing 90 may extend from the impeller shaft housing 80. As illustrated in FIGS. 30-35, the shaft input housing 90 may include a proximal shaft input housing flange 92 which may be bolted, welded and/or otherwise attached to the distal housing flange 83 of the impeller shaft housing 80 and a distal shaft input housing end 91 opposite the proximal shaft input housing flange 92. At least one shaft input flange support 94 may extend from the distal shaft input housing end 91 of the shaft input housing 90. At least one shaft input flange 93 may terminate the shaft input flange support 94. A shaft input housing interior 96 (FIG. 33) may extend from the proximal shaft input housing flange 92 to the distal shaft input housing end 91. As illustrated in FIG. 33, a drive shaft hearing 95 may be disposed in the shaft input housing interior 96 to accommodate the impeller shaft 52 as it traverses the input housing interior 96, as further illustrated in FIG. 36. At least one weep hole 97 may be provided in the shaft input housing 90 for the purpose of draining residual water and/or other liquid 142 from the shaft input housing 90.

In some embodiments, a flange mount 99 may extend from the shaft input housing 90 at the distal housing input housing end 91. The flange mount 99 may be disposed at an acute angle to the longitudinal axis of the shaft, input housing 90. At least one housing mount flange 98 may terminate the flange mount 99 for typically flanged attachment to the external assembly support structure 103 (FIGS. 1A and 1B) for the pump assembly 1 in some, applications. In some, embodiments, at least one deployment flange 12 may be provided on the exterior surface of the shaft input housing 90 for attachment to a crane or other support vehicle or structure (not illustrated) to deploy the pump assembly 1 in place.

Referring again to FIGS. 1A, 1B, 2, 3 and 36 of the drawings, in typical application, the pump assembly 1 may be assembled and, erected or installed between the area to be drained 116 and the discharge area 118 to pump the water and/or other liquid 142 (FIG. 1B) from, the area to be drained 116 to the discharge area 118. In some applications, the area to be drained 116 may include a floodplain ditch and/or other area or areas prone to flooding, and the discharge area 118 may include a river, lake and/or other natural or manmade body of water or other reservoir, for example and without limitation. The levee 122 may separate, the discharge area 118 from the area to be drained 116. Accordingly, the power unit 100 may be installed on an elevated portion of the ground 120 and/or on a power unit stand 101 or other support structure between the area to be drained 116 and the levee 122. The power unit 100 may drivingly engage a drive shaft 105. The impeller shaft 52 may be drivingly coupled to the drive shaft 105 through a suitable shaft coupling (not illustrated).

The pumping unit 34 may be assembled as follows. The impeller 36 may be assembled by placing the impeller assembly 48 in the impeller interior 44 of the impeller housing 37, as illustrated in FIG. 11B, with the impeller blade intake end 51 of the impeller screw blades 50 disposed proximate the impeller housing intake end 39 of the impeller housing 37 and the impeller blade outlet end 53 of the impeller screw blades 50 disposed proximate the impeller housing outlet end 40 of the impeller housing 37. The impeller shaft 52 may be drivingly coupled to the impeller hub 49 according to the knowledge of those skilled in the art.

The intake cap 54 may be attached to the impeller intake end 39 of the impeller housing 37 via a threaded, flanged, bolted and/or other attachment technique known by those skilled in the art. The impeller shaft 52 may be extended through the shaft hub 59 (FIG. 6) in the intake cap interior 58 of the intake cap 54 and may protrude from the intake cap 54 through the intake cap opening 57 (FIG. 6) in the intake flange cap 56. The protruding end of the impeller shaft 52 may be drivingly coupled to the sump 108 (FIGS. 1A and 1B), as will be hereinafter further described.

The impeller shaft 52 may be extended through the diffuser hub 31 (FIGS. 14 and 16) of the diffuser housing 21 of the diffuser 20. The diffuser intake end 23 of the diffuser housing 21 of the diffuser 20 may he attached to the impeller outlet end 40 of the impeller housing 37 of the impeller 36 through a flanged and bolted and/or other suitable attachment technique.

The impeller shaft 52 may be extended through the shaft hearing 15 (FIG. 19) in the pump extension interior 10 of the pump extension housing 3 of the pump extension 2. The pump extension intake end 4 of the pump extension housing 3 may be attached to the diffuser outlet end 24 on the diffuser housing 21 of the diffuser 20 through a flanged and bolted and/or other suitable attachment technique.

The impeller shaft 52 may be extended through the shaft bearing 72 (FIG. 25) in the shaft housing segment 74 of the main pump housing 64. The main housing intake end 69 on the intake pump housing segment 66 of the main pump housing 64 may he coupled to the pump extension outlet end 5 on the pump extension housing 3 of the pump extension 2 through a flanged and bolted and/or other suitable attachment technique.

The impeller shaft 52 may be extended through the shall bearing 85 (FIG. 27) in the housing interior 84 of the impeller shaft housing 80. At least one impeller shaft housing 80 may be attached to the shaft housing segment 74 of the main pump housing 64 typically by bolted attachment of the proximal housing flange 82 on the impeller shaft housing 80 to the companion distal housing flange 75 on the shaft housing segment 74.

The impeller shaft 52 may he extended through the drive shaft bearing 95 (FIG. 33) in the shaft input housing interior 96 of the shaft input housing 90 and through the shaft input flange 93 at the distal or extending end of the shaft input flange support 94. The shaft input housing 90 may be attached to the impeller shaft housing 80 typically by bolted attachment of the proximal shaft input housing flange 92 on the shaft input housing 90 to the companion distal housing flange 83 on the impeller shaft housing 80.

The assembled pump assembly 1 may be erected and deployed in place by engagement of cables on a crane or other support or lifting vehicle or structure (not illustrated) with the deployment flanges 12 on the pump extension 2, the main pump housing 64, the impeller shaft housing 80 and the shaft input housing 90. The assembly support structure 103 (FIGS. 1A and 1B) may be erected between the ground 120 and the shaft input housing 90. The housing mount flange 98 on the flange mount 99 of the shaft input housing 90 may be attached to the typically flanged upper end of the assembly support structure 103. The portion or segment of the impeller shaft 52 which extends beyond the shaft input flange 93 of the shaft input housing 90 may be coupled to the device shaft 105 typically via a suitable shaft coupling (not illustrated). As illustrated in FIG. 1B, in the assembled pump assembly 1, the longitudinal pumping unit axis 35 of the pumping unit 34 may be oriented in a sloped or angled configuration.

As illustrated in FIGS. 1A and 1B, in some applications, a sump 108 may be placed in the area to be drained 116. The sump 108 may be submerged beneath the level of water or other liquid 142 in the area to be drained 116. The intake cap 54 of the pumping unit 34 may be placed in fluid communication with the sump 108. The portion or segment of the impeller shaft 52 which extends from the intake cap 54 may be drivingly coupled to the sump 108. As illustrated in FIG. 1B, in some applications, particulate water filtration material 140 such as sand, rocks and/or gravel, for example and without limitation, may be placed over the sump 108 and beneath the water or other liquid 142 for water filtration purposes.

As illustrated in FIGS. 1A and 1B, the drain conduit 112 may include a drain conduit inlet segment 113 which may be coupled to the main pump housing outlet end 70 (FIG. 2) of the outlet pump housing segment 68 on the main pump housing 64 through a bolted and flanged and/or other suitable attachment technique. As illustrated in FIG. 1A, a drain conduit ascending segment 114 may extend from the drain conduit inlet segment 113. The drain conduit ascending segment 114 may extend through a portion of the levee 122. A drain conduit discharge segment 115 having a discharge end 124 may extend from the drain conduit ascending segment 114. The drain conduit discharge segment 115 may extend through the remaining portion of the levee 122, and the discharge end 124 may discharge at the discharge area 118.

The power unit 100 may he operated to rotate the drive shaft 105, which may transmit rotation to the impeller shaft 52 typically through the shaft coupling (not illustrated). The impeller shaft 52 may drive the sump 108 as well as rotate the impeller assembly 48 in the impeller interior 44 of the impeller housing 37 of the impeller 36. Accordingly, the sump 108 may draw the water and/or other liquid 142 through the water filtration material 140 into the sump 108. Simultaneously, as illustrated in FIG. 1B, the impeller screw blades 50 (FIG. 11B) of the impeller assembly 48 may draw the water or other liquid 142 from the sump 108 through intake cap 54, the impeller 36, the diffuser 20 and the pump extension 2, respectively, of the pumping, unit 34. The water or other liquid 142 may then flow through the intake pump housing segment 66, the middle pump housing segment 67 and the outlet pump housing segment 68, respectively, of the main pump housing 64 and through the drain conduit inlet, segment 113, the drain conduit ascending segment 114 and the drain conduit discharge segment 115, respectively, of the drain conduit 112 and through the discharge end 124 into the discharge area 118. As the water and/or other liquid 142 flows from the area to be drained 116 through the water filtration material 140 to the sump 108, a substantial quantity of impurities may be removed from the water and/or other liquid 142 before it is transported to and discharged into the discharge area 118. This expedient may substantially reduce the environmental impact of the water and/or other liquid 142 in the discharge area 118, particularly in applications in which the water in the discharge area 118 serves as a source of potable water for homes, businesses or communities.

As the water and/or other liquid 142 flows through the diffuser housing 21 of the diffuser 20, the diffuser vanes 30 may increase the efficiency of the pumping unit 34 by facilitating a more gradual expansion and less turbulent area in which the water and/or other liquid 142 can reduce in velocity.

Throughout operation of the pump assembly 1, some of the water and/or other liquid 142 may enter the impeller shaft housing 80 and the shaft input housing 90 from the shaft housing segment 74 of the main pump housing 64. The residual water and/or other liquid 142 may be discharged from the shaft input housing interior 96 of the shaft input housing 90 through the weep hole 97.

It will be appreciated by those skilled in the art that the impeller assembly 48 of the impeller 36 may have any desired number of impeller screw blades 50 on the impeller hub 49. However, it has surprisingly been found that an impeller assembly 48 having two impeller screw blades 50 is more efficient than an impeller assembly 48 having three or more impeller screw blades 50. Accordingly, the impeller assembly 48 may optimally have two impeller screw blades 50 on the impeller hub 49 for the most efficient operation of the pump assembly 1.

It will further be appreciated by those skilled in the art that the components of the pumping unit 34 and the pump assembly 1 may be fabricated in various sizes and lengths depending on the desired pumping capacity of the pump assembly 1 as well as the distance between the area to be drained 116 and the discharge area 118, the depth of the area to be drained 116 and the height of the levy 122. For example and without limitation, in some applications, as illustrated in FIG. 2, in various applications, the pump diameter 18 of the impeller 36, diffuser 20 and pump extension 2 may be 12, 18 or 24 inches whereas the outlet diameter 63 of the outlet pump housing segment 68 of the main pump housing 64 may be 18, 24 or 30 inches, respectively. In other applications, these dimensions may vary. Any number of pump extensions 2 may be coupled to the diffuser 20 in end-to-end relationship to each other to achieve any desired length of the pumping unit 34 to fit a desired application. Any desired number of the, pump extensions 2 may be attached to the diffuser 20 to facilitate a desired length of the pumping, unit 34 for a particular application. Additionally, any desired number of the impeller shaft housings 80 may be placed between the main pump housing 64 and the shaft input housing 90 to achieve a desired length of the pump assembly 1.

In some applications, the pumping unit 34 may be fabricated using releasable, bolted and flanged connections between the intake cap 54 and the impeller 36, between the impeller 36 and the diffuser 20 and between the diffuser 20 and the pump extension or extensions 2. Additionally, flanged and bolted connections may likewise be used between the main pump housing 64 and the pump extension 2 of the pumping unit 34 and between the impeller shaft housing 80 and the main pump housing 64 and between the shaft input housing 90 and the impeller shaft housing 80. This expedient may facilitate ease in shipping and installation of the pump assembly 1 as well as maintenance and replacement of parts and disassembly of the pump assembly 1 under circumstances in which the pump assembly 1 is no longer necessary.

Referring next to FIGS. 37-40 of the drawings, in some applications, the pumping unit 34 may be assembled in a pump assembly 1*a* which is configured as a re-lift pump 126. Accordingly, a re-lift cap 128, having a re-lift cap housing 129 with a re-lift cap flange 130, may be attached to the pump extension outlet end 5 on the pump extension housing 2 of the pump extension 2, typically via a flanged and bolted, connection. A horizontal drain conduit arm 131 may extend from the re-lift cap housing 129 of the re-lift cap 128.

Figure 40:
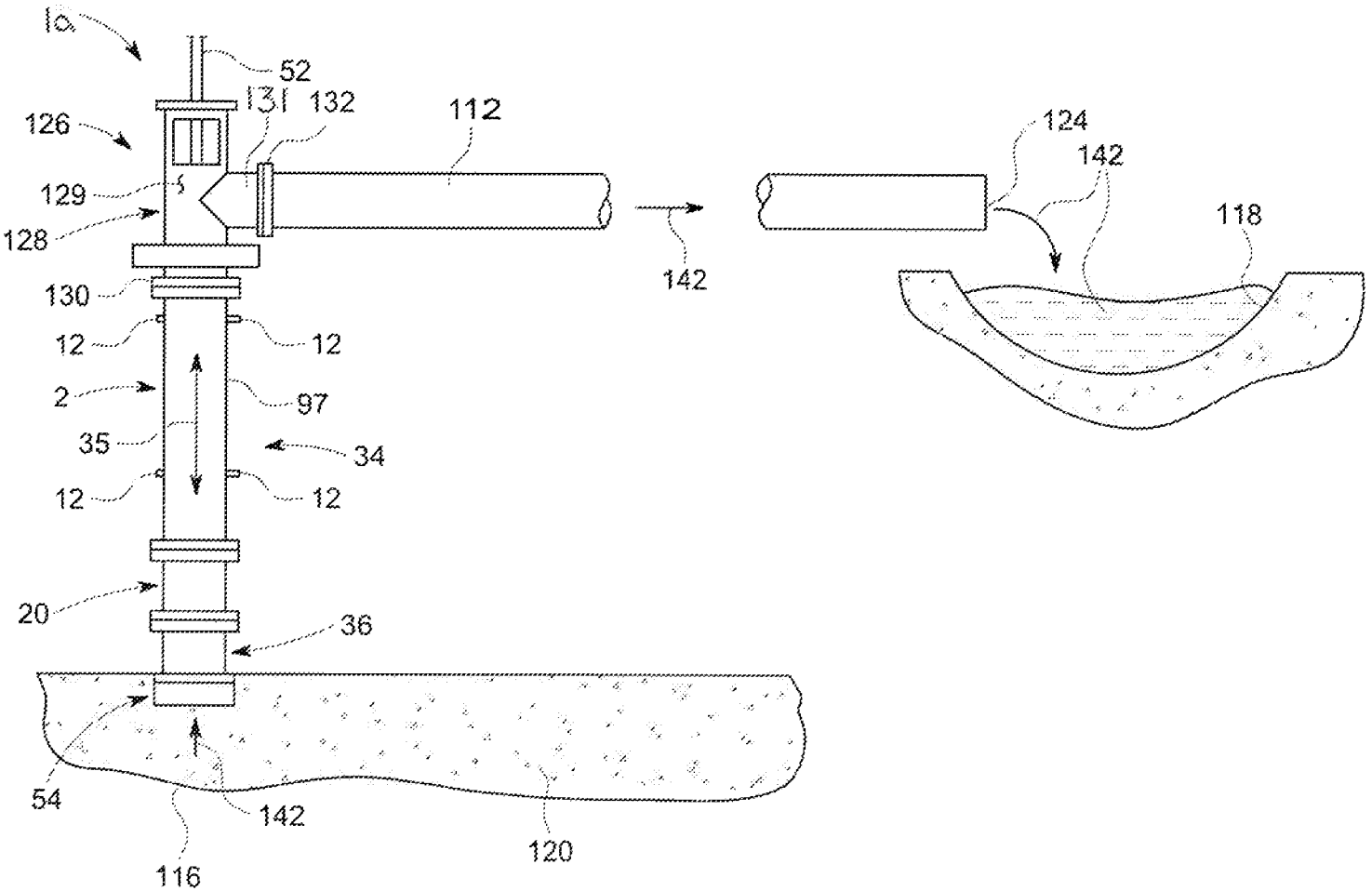
FIG. 40 is a side view of the re-lift pump in typical application thereof.

As illustrated in FIG. 40, in typical operation of the pump assembly 1*a,* the longitudinal pumping unit axis 35 of the pumping unit 34 may be oriented vertically and the re-lift cap 54 placed in fluid communication with an underground source of water and/or other liquid 142 at an area to be drained 116 in or beneath the ground 120. The drain conduit 112 may be coupled in fluid communication with the drain conduit arm 131 of the re-lift cap 128 typically through a flanged and bolted connection. The discharge end 124 of the drain conduit 112 may be placed in fluid communication with a discharge area 118 to which the water and/or other liquid 142 is to be discharged. The impeller shaft 52 may be drivingly coupled to a power unit (not illustrated) and extended through the re-lift cap 128 and the pump extension 2 and the diffuser 20 of the pumping, unit 34 and drivingly coupled to the impeller assembly 48 (FIG. 11B) of the impeller 36 in the pumping unit 34.

In operation of the re-lift pump 126, the power unit may rotate the impeller shaft 52. The impeller shaft 52 may rotate the impeller assembly 48 (FIG. 11B) in the impeller interior 44 of the impeller housing 37 such that the impeller assembly 48 draws the water and/or other liquid 142 from the area to be drained 116 through the intake cap 54, the impeller 36, the diffuser 20 and the pump extension 2, respectively, of the pumping unit 34 and then through the re-lift cap 129 and drain conduit arm 131, respectively, of the re-lift cap 128. The water and/or other liquid 142 may flow from the re-lift, cap 128 through the drain conduit 112 and into the discharge area 118.

Figure 39:
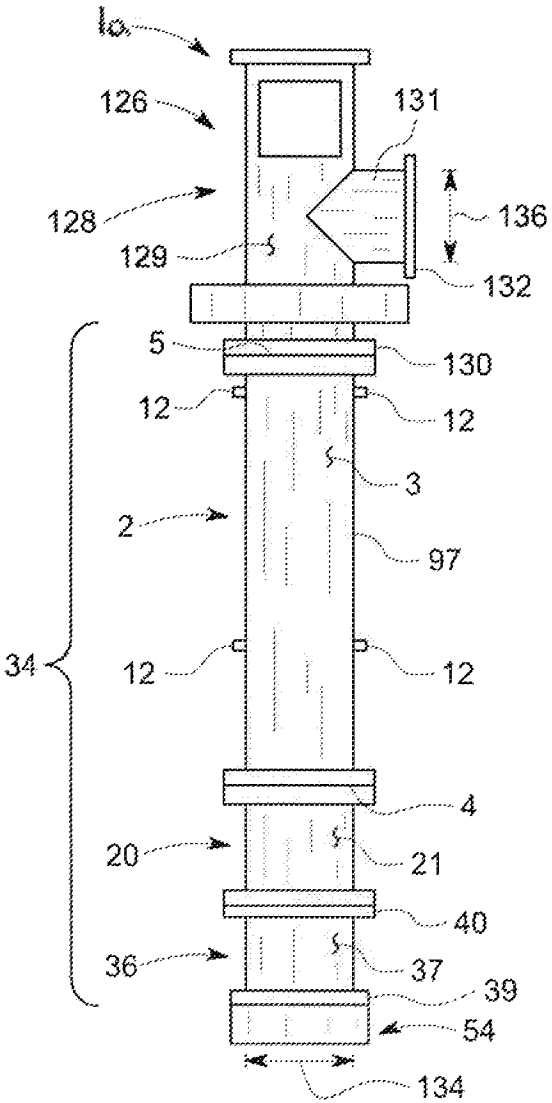
FIGS. 37-39 are side views, respectively, of an alternative illustrative embodiment of the pump assemblies, configured as re-lift pumps having different sizes according to an illustrative embodiment of the pump assemblies of the disclosure.
Figure 38:
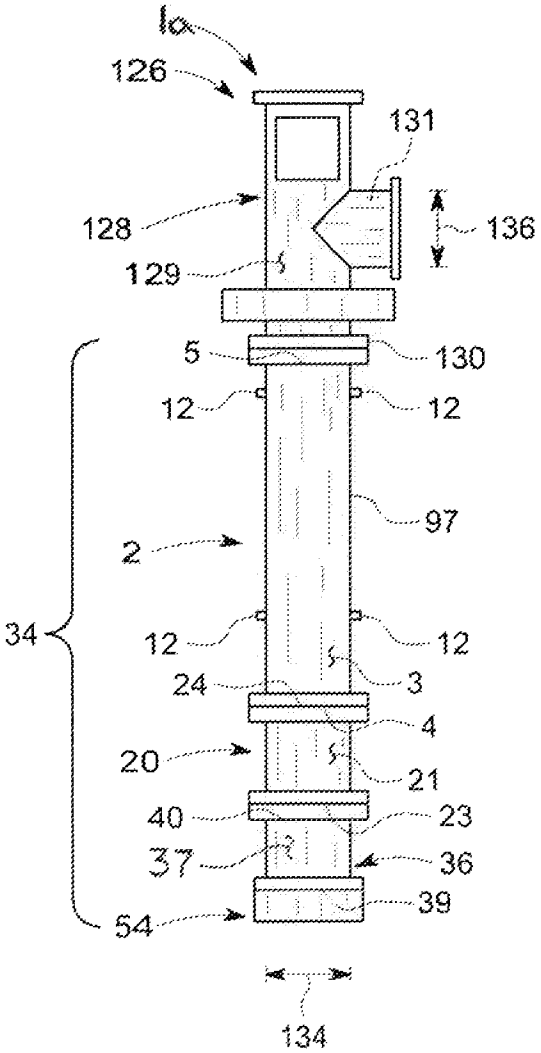
Figure 37:
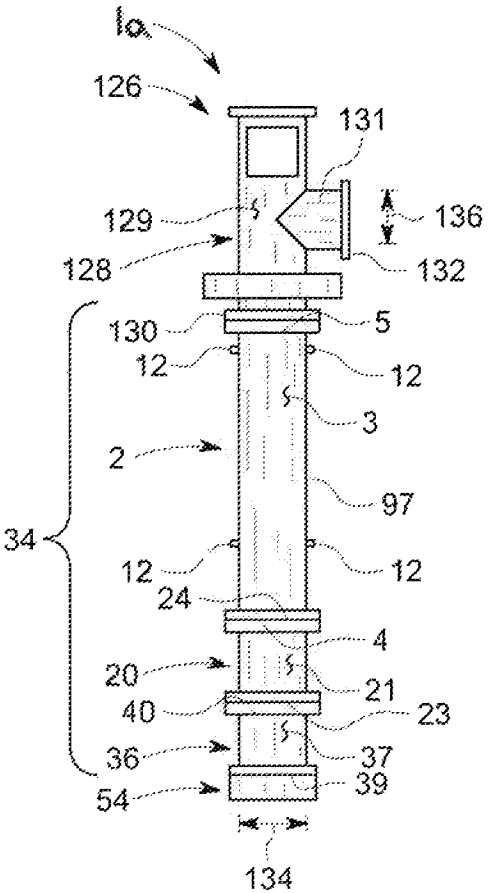

It will be appreciated by those skilled in the art that the components of the pumping unit 34 and the re-lift pump 126 may be fabricated in various sizes and lengths depending on the desired pumping capacity of the re-lift pump 126 as well as the height which the water and/or other liquid 142 is to be pumped to the drain conduit 112. For example and without limitation, in some applications, as illustrated in FIGS. 37-39, the pump diameter 134 of the pumping unit 34 and the discharge diameter 136 of the drain conduit arm 131 on the re-lift cap 128 may each be 12 inches (FIG. 37), 18 inches (FIG. 38) or 24 inches (FIG. 39). In other applications, these dimensions may vary. Any number of pump extensions 2 may be coupled to the diffuser 20 in end-to-end relationship to, each other to achieve any desired height of the pumping unit 34 to fit a desired application of the re-lift pump 126.

In some applications, the re-lift cap flange 130 on the re-lift cap 128 may be bolted and/or otherwise releasably attached to the pump extension outlet end 5 of the pump extension 2. This expedient may facilitate interchangeability of the pumping unit 34 in the pump, assembly 1*a* configured as the re-lift pump 126 or the pump assembly 1 which was heretofore described with respect to FIGS. 1A, 1B, 2 and 3.

Figure 41:
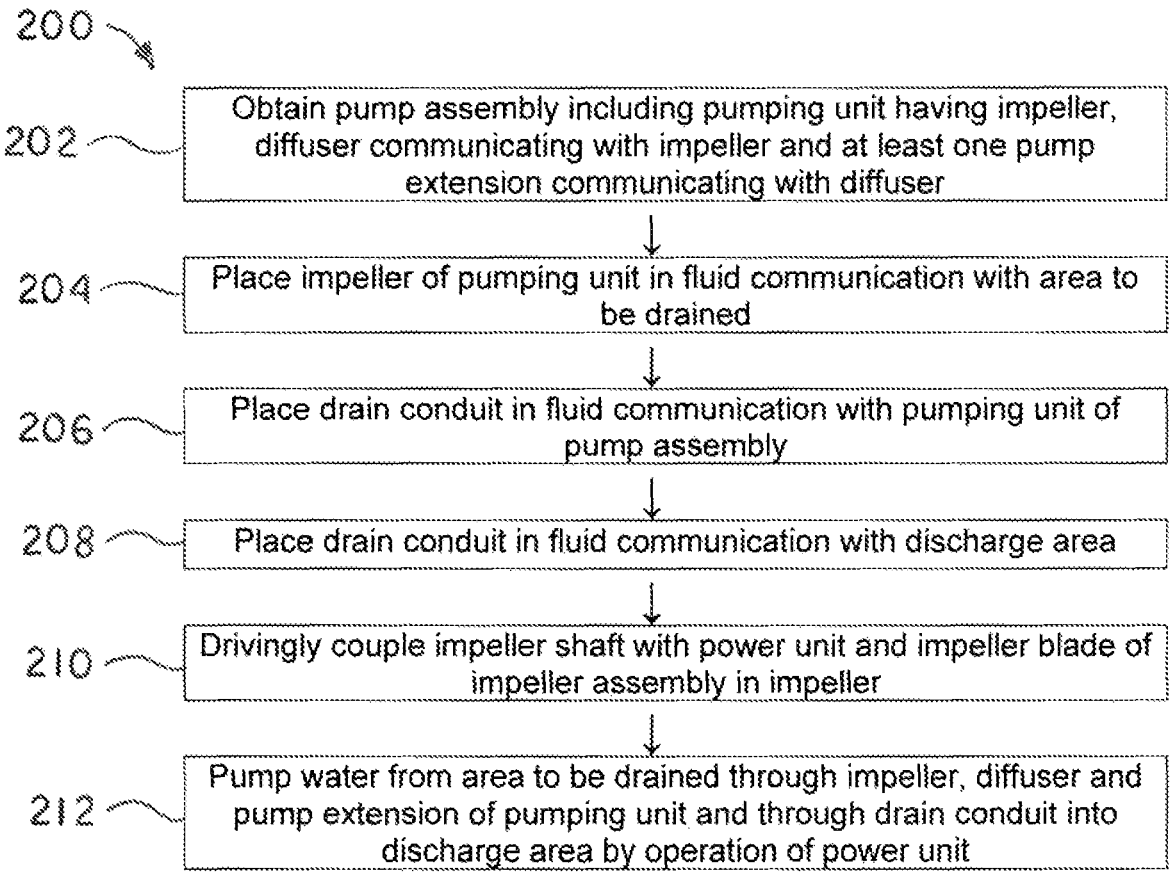
FIG. 41 is a flow diagram of an illustrative embodiment of the pumping methods of the disclosure.

Referring next to FIG. 41 of the drawings, a flow diagram 200 of an illustrative embodiment of the pumping methods of the disclosure is illustrated. At Step 202, a pump assembly may be obtained. The pump assembly may include a pumping unit having at least one impeller, at least one diffuser communicating with the impeller and at least one pump extension communicating with the diffuser. In some applications, the, pump assembly may be configured as a levee pump. In other applications, the pump assembly may be configured as a re-lift pump. In still other applications, other configurations of pump assemblies are possible.

At Step 204, the impeller of the pumping unit may be placed in fluid communication with an area to be drained.

At Step 206, a drain conduit may be placed in fluid communication with the pumping unit of the pump assembly.

At Step 208, the drain conduit may be placed in fluid communication with a discharge area.

At Step 210, an impeller shaft may be drivingly coupled to a power unit and to an impeller assembly having at least one impeller blade in the impeller.

At Step 212, water and/or other liquid may be pumped from the area to he drained through the impeller, the diffuser and the pump extension, respectively, of the pumping unit and through the drain conduit into the discharge area by operation of the power unit.

While certain illustrative embodiments of the disclosure have been described above, it will, be recognized and understood that various modifications can be made to the embodiments and the appended claims are intended to cover all such modifications which may fall within the spirit and scope of the disclosure.

What is claimed is:

1. A pump assembly suitable for driving, connection to a power unit to pump liquid from an area to be drained to a discharge area, comprising:

a pumping unit including:

an impeller having:

an impeller housing with an impeller housing intake end, an impeller housing outlet end and an impeller housing interior extending from the impeller housing intake end to the impeller housing outlet end; and an impeller assembly in the impeller housing interior of the impeller housing and confined between the impeller housing intake end and the impeller housing outlet end, the impeller assembly including:

an impeller hub:

at least one impeller screw blade extending from the impeller hub; and an impeller shaft drivingly engaging the impeller hub for rotation of the impeller assembly in the impeller housing interior, the impeller shaft configured for driving connection to the power unit;

an intake cap carried by the impeller housing of the impeller, the intake cap an intake cap housing including a cylindrical housing sidewall having a cap sidewall intake end and a cap sidewall outlet end, the housing sidewall continuous from the cap sidewall intake end to the cap sidewall outlet end, with an intake end plane of the cap sidewall intake end parallel to an outlet end plane of the cap sidewall outlet end, an intake cap housing flange protruding inwardly from the intake cap housing, an intake cap interior formed by the intake rap housing, an intake cap opening extending through the intake cap housing flange, a central shaft hub disposed in the intake cap interior and receiving the impeller shall and a plurality of intake cap vanes extending inwardly from the intake cap housing into the intake cap interior to mount the shaft hub in the intake cap interior, the intake cap housing detachably coupled to the impeller housing intake end of the impeller housing of the impeller; and a diffuser having:

a diffuser housing with a diffuser housing intake end disposed in fluid communication with and detachably coupled to the impeller housing outlet end of the impeller housing of the impeller, a diffuser housing outlet end and a diffuser housing interior extending from the diffuser housing intake end to the diffuser housing outlet end: and a diffuser huh in the diffuser housing interior, the diffuser hub having a concentric outward taper from the diffuser housing intake end to the diffuser housing outlet end of the diffuser housing;

a plurality of diffuser vanes extending from the diffuser hub in the diffuser housing interior of the diffuser housing and confined between the diffuser housing intake end and the diffuser housing outlet end; and at least one pump extension having a pump extension housing with a pump extension housing intake end disposed in fluid communication with and detachably coupled to the diffuser housing outlet end of the diffuser housing, a pump extension housing outlet end and a pump extension housing interior extending from the pump extension housing intake end to the pump extension housing outlet end; and whereby the intake rap is removable from the impeller as a first discrete unit, the impeller is removable from the diffuser as a second discrete unit and the diffuser is removable from the at least one pump extension as a third discrete unit.

2. The pump assembly of claim 1 further comprising a main pump housing including:

an intake pump housing segment disposed in fluid communication with the pump extension housing outlet end of the pump extension housing;

a middle pump housing segment disposed in fluid communication with the intake pump housing segment, the middle pump housing segment disposed at an obtuse angle to the intake pump housing segment;

an outlet pump housing segment disposed in fluid communication with the middle pump housing segment, the outlet pump housing segment disposed in linear alignment with the middle pump housing segment;

a main pump housing interior formed by the intake pump housing segment, the middle pump housing segment and the outlet pump housing segment;

a shaft housing segment extending from the outlet pump housing segment and disposed in fluid communication with the main pump housing interior, the shall housing segment disposed in linear alignment with the intake pump housing segment; and wherein the impeller shaft extends through the impeller housing interior of the impeller housing of the impeller, the diffuser housing interior of the diffuser housing of the diffuser, the pump extension housing interior of the pump extension housing of the pump extension and the intake pump housing segment, the middle pump housing segment and the shaft housing segment of the main pump housing.

3. The pump assembly of claim 2 further comprising at least one impeller shaft housing disposed in communication with the shaft housing segment of the main pump housing, and wherein the impeller shaft extends through the at least one impeller shaft housing.

4. The pump assembly of claim 3 further comprising a shall input housing disposed in communication with the at least one impeller shaft housing, and wherein the impeller shaft extends through the shaft input housing.

5. The pump assembly of claim 4 further comprising at least one shaft input flange support extending from the shaft input housing and a shaft input flange carried by the at least one shaft input flange support, and wherein the impeller shaft extends through the shaft input flange.

6. The pump assembly of claim 1 wherein the at least one impeller screw blade comprises two impeller screw blades.

7. The pump assembly of claim 1 wherein the impeller hub is tapered.

8. A pump assembly configured as a re-lift pump suitable for driving connection to a power unit to pump liquid to a discharge area, comprising:

a vertically oriented pumping unit including:

at least one impeller having:

an impeller housing with an impeller housing intake end, an impeller housing outlet end and impeller housing interior extending from the impeller housing intake end to the impeller housing outlet end; and an impeller assembly in the impeller housing interior of the impeller housing and confined between the impeller housing intake end and the impeller housing outlet end, the impeller assembly including:

an impeller hub;

at least one impeller screw blade extending from the impeller hub, the at least one impeller screw blade having an impeller blade intake end disposed proximate the impeller housing intake end and an impeller blade outlet end disposed proximate the impeller housing outlet end of the impeller housing; and an impeller shaft drivingly engaging the impeller hub for rotation of the impeller assembly in the impeller housing interior, the impeller shaft configured for driving connection to the power unit;

an intake cap carried by the impeller housing the impeller, the intake cap having:

an intake cap housing including a cylindrical housing sidewall having a cap sidewall intake end and a cap sidewall outlet end, the housing sidewall continuous from the cap sidewall intake end to the cap sidewall outlet end, with an intake end plane of the cap sidewall intake end parallel to an outlet end plane of the cap sidewall outlet end, an intake cap housing flange protruding inwardly from the intake cap housing, an intake cap interior formed by the intake cap housing, an intake cap opening extending through the intake cap housing flange, a central shaft huh disposed in the intake cap interior and receiving the impeller shaft and a plurality of intake cap vanes extending inwardly from the intake cap housing into the intake cap interior to mount the shaft hub in the intake cap interior, the intake cap housing detachably coupled to the impeller housing intake end of the impeller housing of the impeller; and at least, one diffuser having:

a diffuser housing with a diffuser housing intake end disposed in fluid communication with and detachably coupled to the impeller housing outlet end of the impeller housing, a diffuser housing outlet end and a diffuser housing interior extending from the diffuser housing intake end to the diffuser housing outlet end;

a diffuser hub in the diffuser housing interior, the diffuser hub having a concentric outward taper from the diffuser housing intake end to the diffuser housing outlet end of the diffuser housing;

a plurality of diffuser vanes extending from the diffuser hub in the diffuser housing interior of the diffuser housing; and at least one pump extension having a pump extension housing with a pump extension housing intake end disposed in fluid communication with and detachably coupled to the diffuser housing outlet end of the diffuser housing, a pump extension housing outlet end and a pump extension housing interior extending from the pump extension housing intake end to the pump extension housing outlet end;

a re-lift cap including a re-lift cap housing disposed in fluid communication with the pump extension housing outlet end of the pump extension housing of the at least one pump extension;

a horizontal drain conduit arm disposed in fluid communication with the re-lift cap housing; and whereby the intake cap is removable from the impeller as a first discrete unit, the impeller is removable from the diffuser as a second discrete unit and the diffuser is removable from the at least one pump extension as a third discrete unit.

9. The pump assembly of claim 8 wherein the at least one impeller screw blade comprises two impeller screw blades.

10. The pump assembly of claim 8 wherein the impeller hub of the impeller assembly is tapered.

* * * * *